US011459164B2

(12) United States Patent
Mohácsi et al.

(10) Patent No.: US 11,459,164 B2
(45) Date of Patent: Oct. 4, 2022

(54) PILL DISPENSER

(71) Applicant: PEZ AG, Traun (AT)

(72) Inventors: Norbert Mohácsi, Györ (HU); Hilmar Kreisel, Traun (AT)

(73) Assignee: PEZ AG, Traun (AT)

( * ) Notice: Subject to any disclaimer, the term of this patent is extended or adjusted under 35 U.S.C. 154(b) by 82 days.

(21) Appl. No.: 16/963,947

(22) PCT Filed: Jan. 10, 2019

(86) PCT No.: PCT/AT2019/050002
§ 371 (c)(1),
(2) Date: Jul. 22, 2020

(87) PCT Pub. No.: WO2019/157541
PCT Pub. Date: Aug. 22, 2019

(65) Prior Publication Data

US 2021/0039874 A1 Feb. 11, 2021

(30) Foreign Application Priority Data

Feb. 14, 2018 (AT) ..... A 50137/2018

(51) Int. Cl.
*B65D 83/04* (2006.01)
*B65D 51/26* (2006.01)

(52) U.S. Cl.
CPC ..... *B65D 83/0418* (2013.01); *B65D 51/26* (2013.01); *B65D 2583/0481* (2013.01)

(58) Field of Classification Search
CPC ..... B65D 83/0418; B65D 51/26; B65D 2583/0481; B65D 83/0409; A61J 7/0076;
(Continued)

(56) References Cited

U.S. PATENT DOCUMENTS 1,420,377 A * 6/1922 Hopkins ..... G07D 9/002 453/54
2,620,061 A * 12/1952 Uxa ..... A24F 15/16 221/229

(Continued)

FOREIGN PATENT DOCUMENTS

AT 362073 B 4/1981
AT 387760 B 3/1989

(Continued)

OTHER PUBLICATIONS

English abstract for CN206691717U, Dec. 1, 2017.

*Primary Examiner* — Rakesh Kumar
(74) *Attorney, Agent, or Firm* — Tiajoloff & Kelly LLP

(57) ABSTRACT

The invention relates to a pill dispenser (1), which has a sleeve (2) and a magazine (3) guided in this sleeve (2) to hold a stack of pills. For filling purposes, the magazine can be partially pushed out of the sleeve (2) in the longitudinal direction (4) of the magazine against the force of a spring (5) and receives at its upper end a cap (6) in a pivotally adjustable manner, which cap (6) is pivotally adjustable against the force of a spring (7) from a rest position into a dispensing position and supports a decorative head (8). In order to create advantageous fastening conditions for the decorative head, it is proposed that the cap (6) has a transverse guide (9) onto which the at least two-part, in particular at least two-shell, decorative head (8) is pushed transversely to the longitudinal direction (4) of the magazine.

20 Claims, 4 Drawing Sheets

Figure 1:
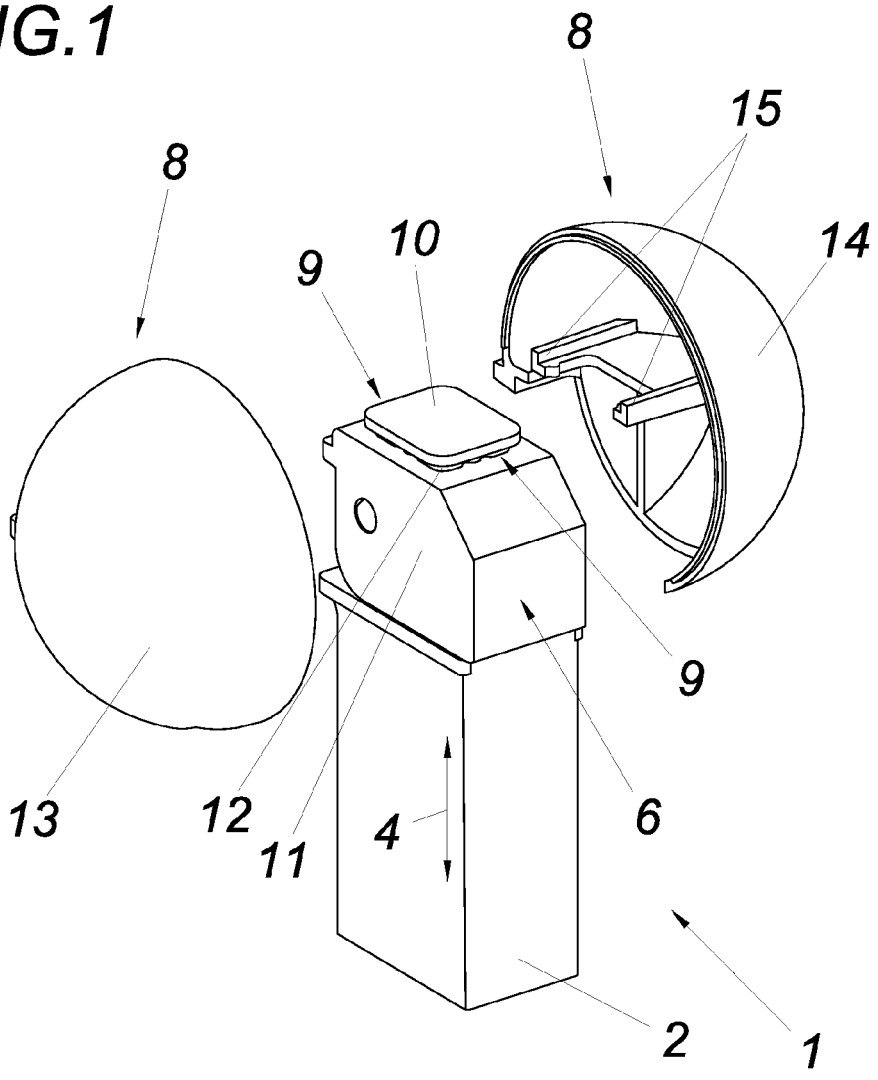

(58) Field of Classification Search
CPC ..... A61J 7/0445; A61J 7/472; A61J 2200/30; G07F 11/16; A24F 15/04
USPC ..... 221/12, 232, 229
See application file for complete search history.

(56) References Cited

U.S. PATENT DOCUMENTS 2,750,072 A * 6/1956 Baldwin ..... G01F 11/24 222/42
2,853,206 A * 9/1958 Uxa ..... B65D 83/0418 221/229
3,119,521 A * 1/1964 Taylor ..... G07D 1/00 221/287
3,313,452 A * 4/1967 Katz ..... A47K 5/08 221/268
3,410,455 A * 11/1968 Haas ..... B65D 83/0418 221/229
3,471,056 A * 10/1969 Kovac ..... B65D 83/0418 221/151
3,511,409 A * 5/1970 Huck ..... A61J 7/04 221/7
3,565,284 A * 2/1971 Hinterreiter ..... B65D 83/0418 221/229
3,578,207 A * 5/1971 Danow ..... A47F 1/126 221/232
3,612,348 A * 10/1971 Thomas ..... B65D 83/0409 221/2
3,612,349 A * 10/1971 Thomas ..... B65D 83/0409 221/4
3,688,945 A * 9/1972 Arlington, Jr. .... B65D 83/0418 206/534
3,762,539 A * 10/1973 Kerr ..... B65D 83/0481 206/537
3,840,149 A * 10/1974 Zeller ..... A63B 57/0032 221/199
3,844,445 A * 10/1974 Haas ..... B65D 83/0418 221/229
3,845,882 A * 11/1974 Hass ..... B65D 83/0418 221/279
3,861,563 A * 1/1975 Lisbin ..... B65D 83/0858 221/279
3,942,683 A * 3/1976 Haas ..... B65D 83/0418 221/229
4,053,242 A * 10/1977 Mast, Jr. ..... A45D 33/00 401/6
4,171,753 A * 10/1979 Vreede ..... B65D 83/0418 206/536
4,187,077 A * 2/1980 Covington ..... G01N 35/00029 221/198
4,295,579 A * 10/1981 Haas ..... B65D 83/0418 206/536
4,311,251 A * 1/1982 Sternberg ..... B65D 83/0418 221/229
4,541,547 A * 9/1985 Miknyocki ..... G07D 1/08 221/260
4,560,086 A * 12/1985 Stol ..... B65D 83/0409 198/724
4,589,575 A * 5/1986 Rigberg ..... B65D 83/0418 206/535
4,592,485 A * 6/1986 Anderson ..... G07F 9/105 165/61
4,792,057 A * 12/1988 Mizer ..... G07D 1/08 221/187
4,872,591 A * 10/1989 Konopka ..... A61J 7/0481 221/3
4,966,305 A * 10/1990 Hinterreiter ..... B65D 83/0418 221/229
4,984,709 A * 1/1991 Weinstein ..... B65D 83/0409 206/536
4,986,442 A * 1/1991 Hinterreiter ..... B65D 83/0418 221/229
5,048,720 A * 9/1991 Hoke ..... B65D 83/0418 221/229
5,071,033 A * 12/1991 Siwek ..... B65D 83/0409 221/229
5,080,258 A * 1/1992 Hinterreiter ..... B65D 83/0418 221/229
5,178,298 A * 1/1993 Allina ..... B65D 83/0418 206/457
5,230,440 A * 7/1993 Kurokawa ..... B65D 83/0418 221/7
5,366,112 A * 11/1994 Hinterreiter ..... B65D 83/0418 221/229
5,460,295 A * 10/1995 Law ..... B65D 83/0418 221/199
5,560,516 A * 10/1996 Hinterreiter ..... B65D 83/0418 221/191
5,785,206 A * 7/1998 Chan ..... G07F 11/14 221/198
5,901,404 A * 5/1999 Lin ..... A46B 7/04 15/184
6,425,495 B1 * 7/2002 Senda ..... B65D 83/0418 221/210
6,543,639 B1 * 4/2003 Kovens ..... B65D 83/0418 221/217
6,564,967 B1 * 5/2003 Stringfield ..... B65D 83/0418 221/229
6,889,869 B2 * 5/2005 Hallin ..... A61J 7/0076 221/270
6,918,509 B2 * 7/2005 Baker ..... B65D 83/0409 221/266
6,997,343 B2 * 2/2006 May ..... B65H 1/00 221/232
7,036,681 B2 * 5/2006 Suda ..... B65D 83/0409 221/210
7,118,550 B2 * 10/2006 Loomis ..... A61F 13/26 604/60
7,204,391 B2 * 4/2007 Toker ..... A61J 7/0076 221/208
7,243,817 B2 * 7/2007 Giraud ..... B65D 83/0409 221/190
7,246,720 B1 * 7/2007 Montoya, Jr. ..... A61F 6/005 221/229
7,264,139 B2 * 9/2007 Brickwood ..... G01N 33/48757 221/268
7,273,158 B1 * 9/2007 Dean ..... A63B 47/002 221/270
7,337,918 B2 * 3/2008 Fowler ..... B65D 83/0829 221/232
7,523,841 B2 4/2009 König
8,523,011 B2 * 9/2013 Haas ..... B65D 83/0418 221/229
8,998,032 B2 * 4/2015 Kuriger ..... G01N 33/48757 221/228
9,039,977 B2 * 5/2015 Chan ..... B65D 83/0829 422/547
9,204,829 B2 * 12/2015 Prais ..... A61B 5/14532
9,597,261 B2 * 3/2017 Baarman ..... A61J 7/0076
9,738,433 B2 * 8/2017 Hogg ..... H01M 50/20
9,764,888 B2 * 9/2017 Tiesberger ..... B65D 83/0409
10,071,846 B2 * 9/2018 Yao ..... B65D 83/0829
10,259,640 B2 * 4/2019 Yao ..... B65D 83/0817
10,577,197 B1 * 3/2020 Burnsed, Jr. ..... B65G 59/02
2002/0043538 A1 * 4/2002 Millar ..... G07F 11/44 221/265
2003/0132239 A1 7/2003 Konig
2007/0034640 A1 * 2/2007 Casale ..... B43M 15/00 221/232
2007/0125794 A1 * 6/2007 Jones ..... G07F 11/14 221/231
2010/0294791 A1 * 11/2010 Weibel ..... B65D 83/0409 221/1
2012/0055948 A1 * 3/2012 Leifeld ..... A61J 7/0076 221/268
2013/0206786 A1 * 8/2013 Diamond ..... B65D 85/60 221/24

(56) References Cited

U.S. PATENT DOCUMENTS

| | | | | |
|---|---|---|---|---|
| 2014/0014677 | A1* | 1/2014 | Chan | B65D 83/0829 221/232 |
| 2017/0043939 | A1* | 2/2017 | Marqua | A61J 1/03 |
| 2018/0147120 | A1* | 5/2018 | Poirier | A61J 7/0472 |
| 2018/0148247 | A1* | 5/2018 | Wright | B65D 85/60 |

FOREIGN PATENT DOCUMENTS

| | | | | | |
|---|---|---|---|---|---|
| CN | 201027055 | Y | | 2/2008 | |
| CN | 202784376 | U | | 3/2013 | |
| CN | 206691717 | U | | 12/2017 | |
| DE | 1039705 | B | | 9/1958 | |
| EP | 1292512 | B1 | | 8/2004 | |
| GB | 871685 | | | 6/1961 | |
| GB | 2078679 | A | | 1/1982 | |
| GB | 2307231 | A | | 5/1997 | |
| JP | S57-46776 | A | | 3/1982 | |
| JP | S59-115780 | U | | 8/1984 | |
| JP | H07-13776 | U | | 3/1995 | |
| JP | 3041320 | U | * | 9/1997 | A45C 11/00 |

* cited by examiner

PILL DISPENSER

FIELD OF THE INVENTION

The invention relates to a pill dispenser which has a sleeve and a magazine guided in said sleeve for receiving a stack of pills, which for filling purposes can be partially pushed out of the sleeve in the longitudinal direction of the magazine against the force of a spring and receives a cap at its upper end in a pivotally adjustable manner, which cap is pivotally adjustable against the force of a spring from a rest position into a dispensing position and supports a decorative head.

DESCRIPTION OF THE PRIOR ART

Such pill dispensers are known from the AT 387 760 A, AT 362 073 A and U.S. Pat. No. 4,311,251 A, for example. The magazine can be pushed out of the sleeve for filling purposes and is then pushed back into the sleeve after filling. At the upper end, the magazine receives in a pivotally adjustable manner a cap having a decorative head of any design. The cap has an ejector tongue in the region of the back of the decorative head and is pivotally adjustable with the decorative head against the force of another spring from a rest position into a dispensing position. When the cap is pivoted with the decorative head, the ejector tongue pushes the topmost pill of the pill stack forward out of the magazine for removal. When this pill is removed, the next pill of the pill stack is pushed in the direction of the cap into a removal chamber. The decorative head is either injection-molded onto the cap or fitted onto the cap in the longitudinal direction of the magazine. If the decorative head is injection-molded thereon, a high material input is required for production. This is also the case with the well-known decorative heads that can be fitted onto the cap, but these have the additional disadvantage that the decorative heads are often only inadequately fitted onto the cap. Such pill dispensers are often used by children for sweets in pill form. Therefore, even in the case of improper use, the user should not be endangered by decorative heads that come off the cap unintentionally.

SUMMARY OF THE INVENTION

The invention is thus based on the object of creating a pill dispenser which is held securely on the cap and in which a decorative head fitted onto a cap can be manufactured preferably with the least possible material input.

The invention solves the set object in that the cap has a transverse guide onto which the decorative head, which is formed from at least two parts, in particular at least two shells, is pushed transversely to the longitudinal direction of the magazine.

Where high strength is required, the decorative head may comprise at least two parts made of solid material. The two-shell design of the decorative head ensures that the decorative head can be manufactured with as little material as possible. The transverse guide ensures that the decorative head cannot be pulled off the cap and is therefore securely held on the cap. In this case, the guide is aligned transversely to the longitudinal direction of the magazine. During assembly, both shells of the decorative head are pushed onto the cap from the front and back or from the left and right during assembly, and are then pushed together under the cap socket, joined together, in particular latched, glued, welded or the like, and engage in the transverse guide, thus ensuring a secure bond between cap and decorative head.

The transverse guide can, for example, include holes in the cap in which pins of the decorative head shells engage. However, because a robust connection is guaranteed, it is particularly preferred if the cap has a retracted cap neck at the head end between a head piece and a cap body, which forms the transverse guide.

If the two shells of the two-shell decorative head are equipped with elastic projections that engage in the transverse guide, this results in particularly advantageous assembly conditions, because the decorative head and cap can then simply be snapped together. For this purpose, the elastic projections can have latching lugs projecting towards the end of the transverse guide, which latching lugs engage in corresponding grooves in the cap neck when the shells are in the assembly position.

In order to ensure that the two shells of the decorative head are joined together cleanly and securely and that they cannot be moved against each other in their abutting plane, it is suggested that the two shells of the two-shell decorative head interlock on the abutting side via a rebate and overlap by the rebate depth.

Preferably, the two shells of the two-shell decorative head enclose the cap at least as much as they completely enclose the cap neck with the resilient projections. This also ensures a secure hold of the decorative head on the cap. In order to avoid impairing the ejection function, it is recommended that the cap and the decorative head have a recess in the area of the back of the decorative head into which an ejector tongue protrudes.

BRIEF DESCRIPTION OF THE INVENTION

Figure 2:
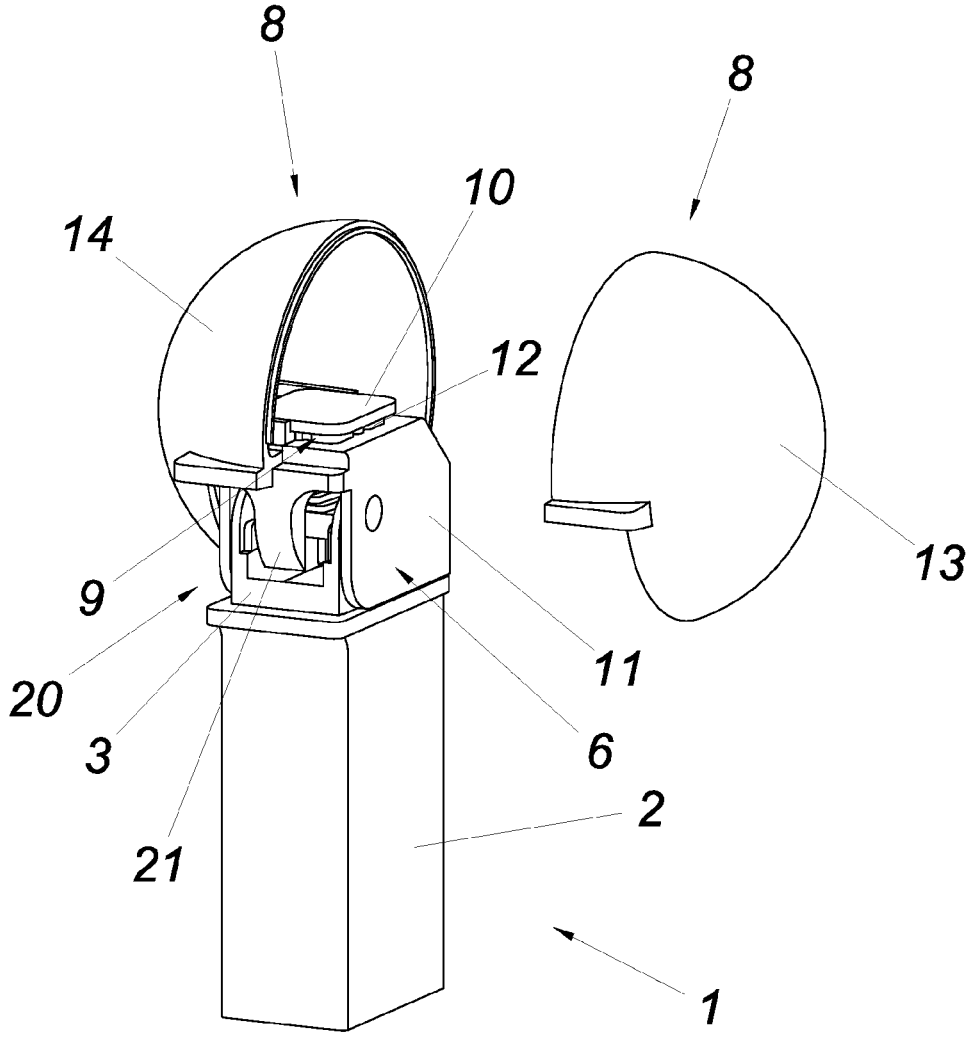
Figure 3:
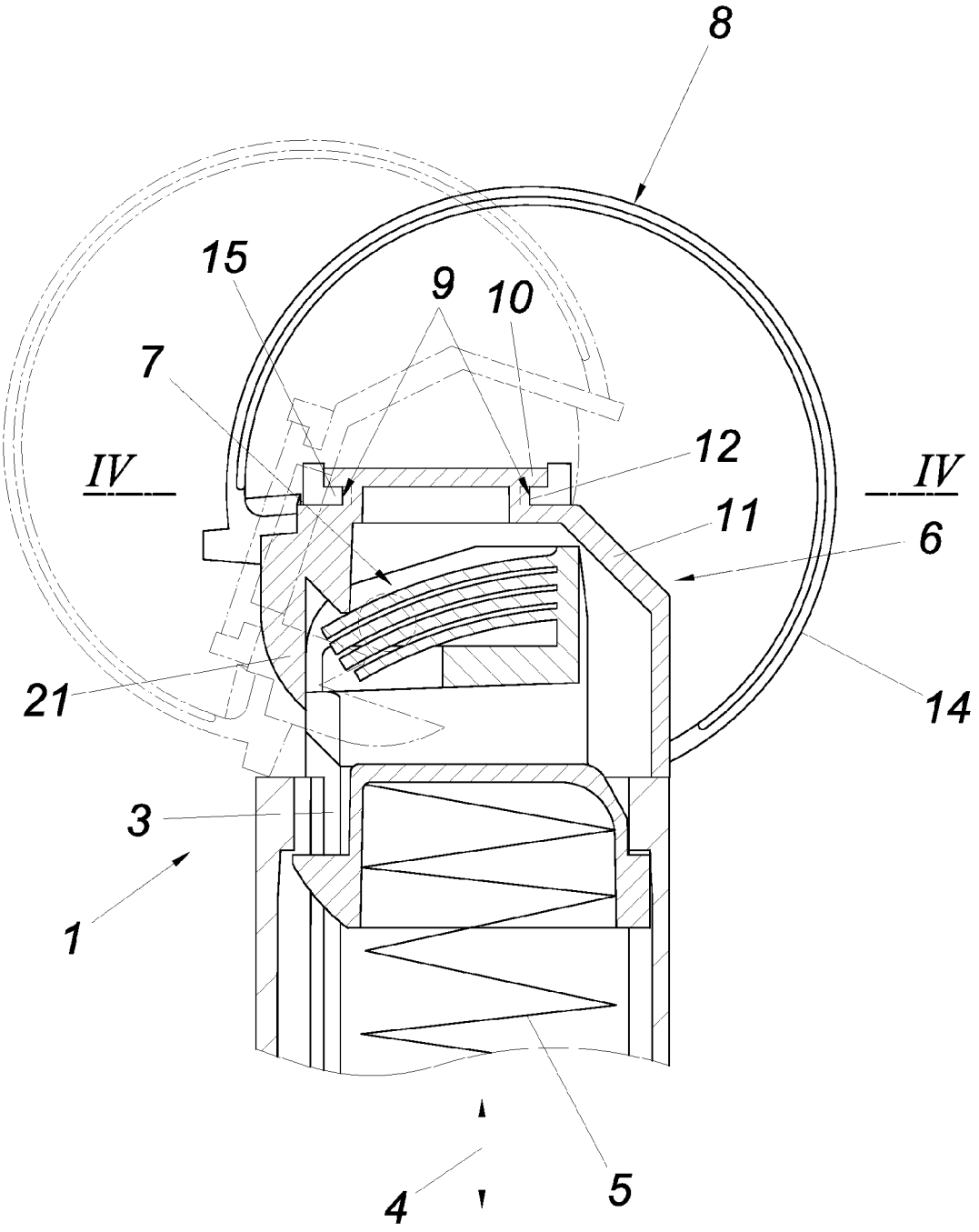
Figure 4:
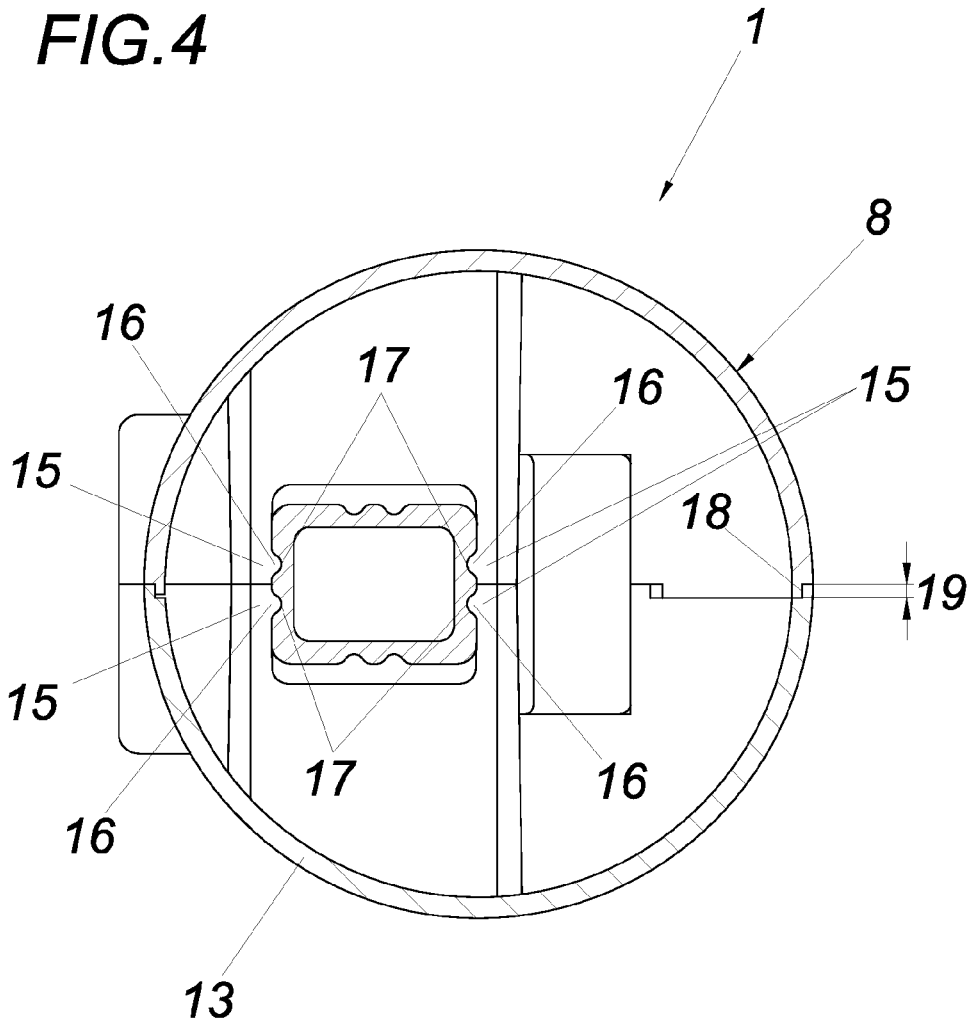

The subject matter of the invention is shown by way of example in the drawings, wherein:

FIG. 1 shows a pill dispenser in oblique view with the decorative head removed, FIG. 2 shows the pill dispenser in another oblique view with only one decorative head shell removed, FIG. 3 shows the cap with decorative head of the pill dispenser in partially sectional side view, and FIG. 4 shows the cap with decorative head from FIG. 3 in section according to line IV-IV.

DETAILED DESCRIPTION OF THE PREFERRED EMBODIMENTS

The pill dispenser 1 comprises a sleeve 2 and a magazine 3 guided in this sleeve 2 to hold a stack of pills. The magazine 3 can be partially pushed out of the sleeve 2 in the longitudinal direction of the magazine 4 against the force of a spring 5 for filling purposes. At the upper end, magazine 3 accommodates a cap 6 in a pivotally adjustable manner, which is pivotally adjustable against the force of another spring 7 from a rest position into a dispensing position (dot-dash line in FIG. 3) and supports a decorative head 8. If the cap 6 with the decorative head 8 is pivoted, a pill is pushed forward out of the magazine underneath the decorative head chin for removal. Once this pill has been removed, the next pill in the pill stack is pushed forward by the spring 5 in the direction of cap 6.

The cap 6 has a transverse guide 9, onto which the decorative head 8, which is formed as a double shell, is pushed transversely to the longitudinal direction of the magazine 4. For this purpose, the cap 6 has a retracted cap neck 12 between a head part 10 and a cap body 11, which forms the transverse guide 9. To fix the decorative head 8 on the cap 6, the two shells 13, 14 of the two-shell decorative head 8 are equipped with elastic projections 15 which engage in the transverse guide 9 between head piece 10 and cap body 11. The two shells 13, 14 of the two-shell decorative head 8 almost completely enclose the cap 6. The cap neck 12 is also completely enclosed by the two shells 13, 14, namely by their elastic projections 15.

The elastic projections 15 have latching lugs 16 which protrude at the ends towards the transverse guide 9 and engage in a latching manner in corresponding grooves 17 of the cap neck 12 in the assembly position of the shells 13, 14. Alternatively, the latching lugs could also be arranged on the cap neck and the projections have the corresponding grooves.

The two shells 13, 14 of the two-shell decorative head 8 interlock on the joint side via a fold 18 and overlap by the fold depth 19. The cap 6 and the decorative head 8 have a recess 20 in the area of the back of the decorative head, into which an ejector tongue 21 protrudes for pushing the respective uppermost pill out of the magazine 4 in the above-mentioned manner.

The invention claimed is:

1. A pill dispenser comprising:

a sleeve; and a magazine guided in said sleeve and configured to receive a stack of pills, wherein said magazine is supported for longitudinal movement relative to the magazine such that when the magazine is partially pushed out of the sleeve in a longitudinal direction of the magazine the longitudinal movement is against a force of a first spring, and said magazine supports a cap at an upper end thereof for pivotal movement;

wherein said cap is pivotally movable against force of a second spring from a rest position to a dispensing position, and said cap supports a head comprising two parts;

wherein the cap has a transverse guide having two portions, each of the two parts of the head being mounted onto a respective one of the two portions, wherein the parts are pushed transversely to the longitudinal direction of the magazine from opposite sides of the transverse guide so that the two parts meet and are secured to each other to form the head, and the head is secured on the cap.

2. A pill dispenser according to claim 1, wherein the cap has a retracted cap neck between a head part and a cap body, wherein the cap neck forms the transverse guide.

3. A pill dispenser according to claim 2, wherein the cap and the head have a recess in a region of a back of the head, into which an ejector tongue extends.

4. A pill dispenser according to claim 1, wherein the cap and the head have a recess in a region of a back of the head, into which an ejector tongue extends.

5. A pill dispenser comprising:

a sleeve; and a magazine guided in said sleeve and configured to receive a stack of pills, wherein said magazine is supported for longitudinal movement relative to the magazine such that when the magazine is partially pushed out of the sleeve in a longitudinal direction of the magazine the longitudinal movement is against a force of a first spring; and said magazine supports a cap at an upper end thereof for pivotal movement;

wherein said cap is pivotally movable against a force of a second spring from a rest position to a dispensing position, and said cap supports a head comprising at least two parts;

wherein the cap has a transverse guide, wherein each of the parts of the head is pushed transversely to the longitudinal direction of the magazine onto the transverse guide; and wherein the parts of the head are two shells, and the two shells of the head have elastic projections that engage the transverse guide.

6. A pill dispenser according to claim 5, wherein the cap and the head have a recess in a region of a back of the head, into which an ejector tongue extends.

7. A pill dispenser according to claim 5, wherein the two shells of the head completely enclose the cap neck.

8. A pill dispenser according to claim 5, wherein the elastic projections have latching lugs projecting at ends thereof towards the transverse guide, and said latching lugs latch in corresponding grooves of the cap neck in an assembled position of the shells.

9. A pill dispenser according to claim 8, wherein the cap and the head have a recess in a region of a back of the head, into which an ejector tongue extends.

10. A pill dispenser according to claim 8, wherein the two shells of the head interlock via a fold and overlap by a depth of the fold.

11. A pill dispenser according to claim 5, wherein the two shells of the head interlock on an abutting surface via a fold and overlap by a depth of the fold.

12. A pill dispenser according to claim 11, wherein the cap and the head have a recess in a region of a back of the head, into which an ejector tongue extends.

13. A pill dispenser according to claim 5, wherein the two shells of the head surround most of the cap.

14. A pill dispenser according to claim 13, wherein the cap and the head have a recess in a region of a back of the head, into which an ejector tongue extends.

15. A pill dispenser comprising:

a sleeve; and a magazine guided in said sleeve and configured to receive a stack of pills, wherein said magazine is supported for longitudinal movement relative to the magazine such that when the magazine is partially pushed out of the sleeve in a longitudinal direction of the magazine the longitudinal movement is against a force of a first spring, and said magazine supports a cap at an upper end thereof for pivotal movement;

wherein said cap is pivotally movable against a force of a second spring from a rest position to a dispensing position, and said cap supports a head comprising at least two parts;

wherein the cap has a transverse guide, wherein each of the parts of the head is pushed transversely to the longitudinal direction of the magazine onto the transverse guide;

wherein the cap has a retracted cap neck at a head end between a head part and a cap body, wherein the cap neck forms the transverse guide and wherein the parts of the head are two shells, and the two shells of the head have elastic projections that engage the transverse guide.

16. A pill dispenser according to claim 15, wherein the elastic projections have latching lugs projecting at ends thereof towards the transverse guide, and said latching lugs latch in corresponding grooves of the cap neck in an assembled position of the shells.

17. A pill dispenser according to claim 16, wherein the two shells of the head interlock via a fold and overlap by a depth of the fold.

18. A pill dispenser according to claim 16, wherein the cap and the head have a recess in a region of a back of the head, into which an ejector tongue extends.

19. A pill dispenser according to claim 15, wherein the two shells of the head interlock via a fold and overlap by a depth of the fold.

20. A pill dispenser according to claim 15, wherein the cap and the head have a recess in a region of a back of the head, into which an ejector tongue extends.

* * * * *